United States Patent [19]

Marshik

[11] Patent Number: 4,642,845

[45] Date of Patent: Feb. 17, 1987

[54] BALANCE ASSEMBLY FOR A WINDOW

[75] Inventor: Gary J. Marshik, Canton, S. Dak.

[73] Assignee: The Celotex Corporation, Tampa, Fla.

[21] Appl. No.: 752,875

[22] Filed: Jul. 8, 1985

[51] Int. Cl.[4] ..... E05D 13/00

[52] U.S. Cl. ..... 16/194; 16/DIG. 16

[58] Field of Search ..... 49/404, 446; 248/297.1, 248/364, 162.1; 16/66, 84, 193, 194, 195, 196, 197, DIG. 16

[56] References Cited

U.S. PATENT DOCUMENTS

| | | | |
|---|---|---|---|
| 621,669 | 3/1899 | Hinds . | |
| 2,428,976 | 10/1947 | Macklanburg | 16/202 |
| 3,358,403 | 12/1967 | Dinsmore | 49/445 |
| 3,676,956 | 7/1972 | Taylor et al. | 49/446 |
| 4,004,372 | 1/1977 | Beard et al. | 49/404 |
| 4,230,309 | 10/1980 | Schnitzius | 16/66 |

*Primary Examiner*—M. Jordan

*Attorney, Agent, or Firm*—James W. Grace; Charles W. Vanecek

[57] ABSTRACT

This invention relates to a balance assembly for windows in which a gas pressurized piston and cylinder device with pulley wheels at each end acts as a balance element for the windows.

12 Claims, 7 Drawing Figures

BALANCE ASSEMBLY FOR A WINDOW

BACKGROUND OF THE INVENTION

1. Field of the Invention

Figures 1, 2, 3, 4, 5, 6, 7:
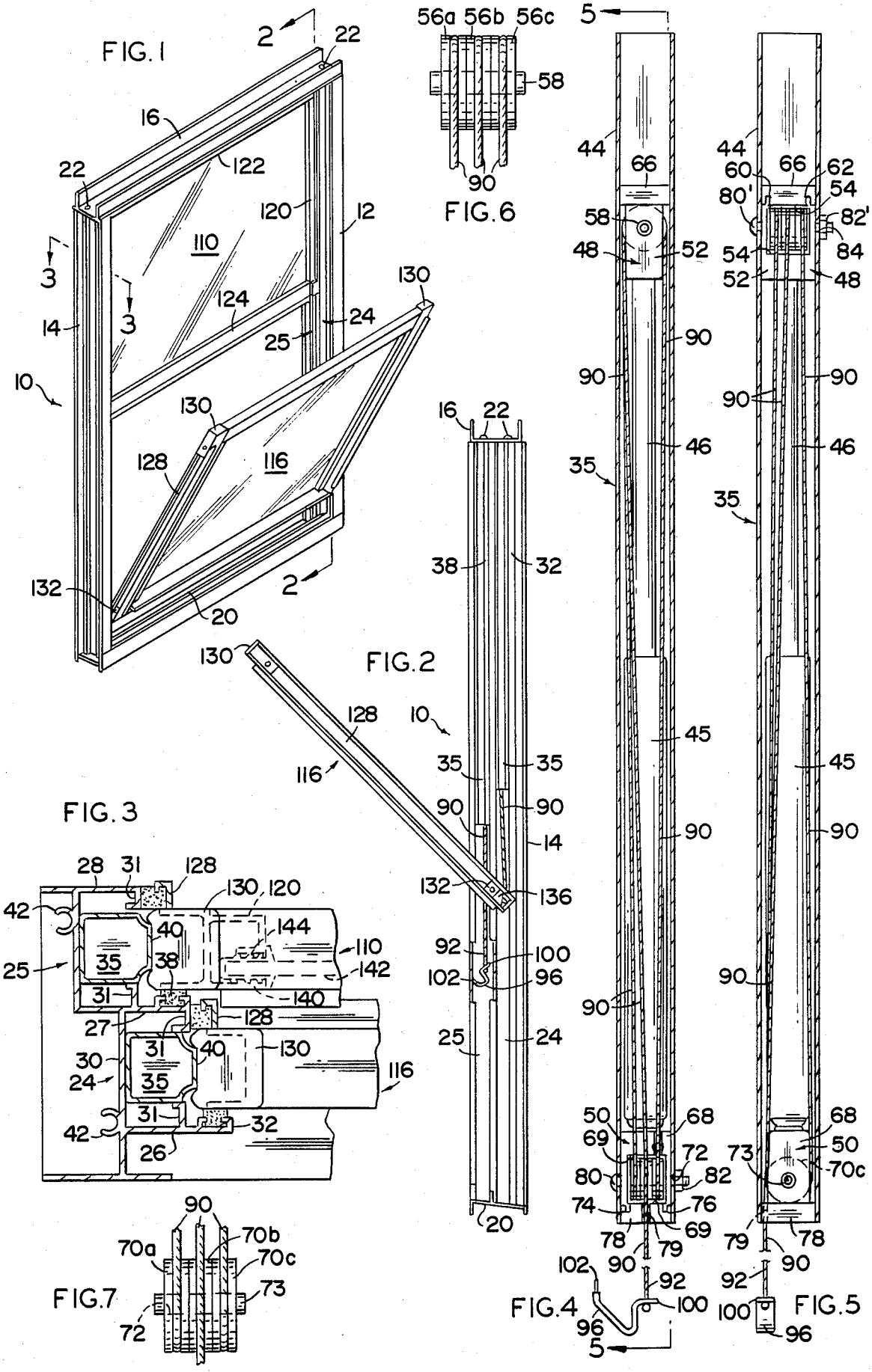

This invention relates to windows, both plural-hung and single sash types and more particularly to an improved balance assembly for windows of this type.

Single and double-hung windows having balance assemblies are well known and in use. Such windows have been made removable from a window casing. The prior patent of Henry J. Taylor and Maurice E. Sterner, Jr., U.S. Pat. No. 3,676,956 dated July 18, 1972 shows one version of such a window construction. That particular construction related to a removable window and was applicable to single and double-hung windows and was particularly adapted to the use of metal window and sash construction. It provided a simplified and improved design of a window which incorporated a balance assembly and in which both sash may be readily removable without translational movement of the same. Further, it provided an improved structure whereby the sash may be moved in any position in the window casing and further provided for a substantially rigid guiding mounting of the sash within the casing. It further provided an improved and simplied weather-stripping of the window sash in the window casing from the outside toward the inside sealing both sides of each sash surfaces for all positions of movement to effectively weather-strip the window. It further required no special latches and permitted a simplified and easy removal of the window.

2. Summary of the Invention

The present invention provides a novel balance assembly for windows which permits smooth operation of the window and avoids certain dangerous conditions inherent in prior art window balance assemblies. In the prior art window constructions, the balance assemblies have used a coil spring which was attached to a multiple pulley assembly. The pulley assembly operated with a sash cord which could break. The great tension applied to the sash cord by the coil spring could cause a violent release of the pulley assembly and cause damage to the window when the sash cord breaks.

It further provides a simple way to increase or decrease the tension without having to keep a large inventory of different springs available. This is accomplished by the fact that a gas pressurized cylinder is used in place of a coil spring and the gas pressure in the cylinder can be easily varied.

Further, by moving a securing bolt or pin from one set of pulley wheels to another, the balance ratio changes and the output tension can be easily increased or decreased.

The balance assembly can be easily adapted for use with windows having different weights because of the ease of adjustment of the output tension.

The present invention provides closure caps which can be easily snapped in place after the sash cord has been laced around the exposed pulleys to make lacing easy. The closure caps then prevent the sash cord from coming out of the pulley wheel grooves.

The present invention also provides a slot in one of the closure caps through which the sash cord leaves the balance assembly. The slot is made narrow so that the connector on the end of the sash cord cannot be drawn back into the balance assembly.

OBJECTS OF THE INVENTION

Therefore, it is the principal object of this invention to provide an improved balance assembly for windows.

Another object of this invention is to provide an improved balance assembly particularly adapted for metal windows.

A further object of the invention is to provide an improved balance assembly in which the tension on the sash cord can be easily changed.

It is yet another object of this invention to provide an improved balance assembly in which the sash cord can be easily laced over exposed pulley wheels and then closure caps are snapped into place to prevent the sash cord from coming out of the pulley wheel grooves.

These and other objects of this invention will become apparent to those skilled in the art from a reading of the attached description together with the drawings wherein like numerals indicate like elements and in which:

FIG. 1 is a perspective view of a removable double-hung window embodying our invention, FIG. 2 is a sectional view of the same taken along the lines 2—2 in FIG. 1 and with one sash removed and a second sash tilted outwardly for removal, FIG. 3 is a sectional view of the window casing and a portion of the sash with parts broken away taken along lines 3—3 of FIG. 1, FIG. 4 is a front view of the improved balance assembly of the invention with a front side removed, FIG. 5 is a cut-away side view of the improved balance assembly taken along lines 5—5 of FIG. 4, FIG. 6 is a detail view of the pulley assembly at one end of the piston of the gas pressure piston and cylinder device, and FIG. 7 is a detail view of the pulley assembly at the opposite end of the gas pressure cylinder of the gas pressure piston and cylinder device.

The improved window with balance having a removable sash is shown in the drawings in connection with a double-hung window. The principles of the invention are equally applicable to single-hung windows and is preferably utilized in metal window construction. Thus in FIG. 1, the window casing is indicated generally at 10 as incorporating side jambs 12 and 14 connected to a head frame 16 and a sill frame 20 to form the general rectangular casing construction. The side jambs, head and sill frames are preferably made of an extruded aluminum and the parts are held together through suitable screws, such as is indicated at 22, extending through apertures in the head and sill frames and into the side jambs.

The side jamb construction will best be seen in the elevation view of FIG. 2 and the sectional view of FIG. 3. Each jamb member has an outer and inner jamb channel, indicated by the numerals 24 and 25, and as will be noted from the cross-sectional configuration of FIG. 3 the outer or upper sash is of a shorter width dimension than the inner or lower sash in the double-hung window. The jamb construction or cross section is so formed as to define the respective channels 24, 25 by flanges 26, 27 and 28 extending transversely out from an irregular base plate portion 30. Flange 26 has a transversely extending guide portion 31 depending therefrom which defines one side of the channel 24 or recess. It further extends outwardly to include a channel-shaped portion 32 which mounts the weather-stripping material which will bear against the outer sash. The same construction exists for flange portion 27. Thus, the flange portions 26, 27 with the guide portions 31 extending transversely therefrom define the recess which extends the length of the jamb channel and in which is positioned the balance assembly, indicated generally at 35. The inner jamb channel is similarly formed between the flange portions 27, 28 with guide flanges 31 extending transversely therefrom to define the opening or the recess forming the inner jamb channel 25 with the flange portion 27 having a weather-stripping portion 38 extending therefrom to bear against the inner sash. Positioned in the upper portion of each of the jamb channels are balance assemblies 35 which are identical in construction and are shown in detail in FIGS. 4 and 5. Balance assembly 35 is generally of rectangular cross-section in shape with an outer projecting guide surface, such as is indicated at 40, for the purpose of guiding the sash thereon. The back side of the base plate 30 includes extending rib portions 42 which are split and which receive the screws 22 holding the head and sill frame portions to the jamb members forming the sides of the casing. Each jamb member is identical in construction and, when assembled with the head frame and sill frame, defines aligned recesses or channels on the sides of the casing to guide the respective sash therein. The sill frame is inclined toward the outside of the window, as will be seen in FIG. 2.

For the purpose of the present disclosure, the balance assembly 35 which is employed and positioned in each of the jamb channels on either side of the sash is shown from the front in FIG. 4 to disclose one version of the same. It includes a generally square-shaped, metal, balance assembly receiving tube 44 having the curved or guide surface 40 on the outer edge of the same and with a gas pressurized cylinder 45 and piston 46 integrally connected to a pulley assembly 48 at the upper end of piston 46 and a second pulley assembly 50 integrally connected to the lower end of cylinder 45. Tube 44 may be made of extruded aluminum or other metal. Tube 44 is secured in the jamb channel by screws or other securing means (not shown).

The cylinder 45 and piston 46 form an assembly which provide the tension for operation of the window in place of the customary coil spring. Cylinder 45 is pressurized with a gas, such as nitrogen and piston 46 works against the pressure in cylinder 45 in the same way that a hatch back trunk lid in an automobile works. Cylinder 45 and piston 46 is a commercially available unit sold by Suspa, Incororated, 3970 Roger B. Chaffee Memorial Drive, Grand Rapids, Mich.

Upper pulley assembly 48 (FIGS. 4 and 5) comprises a pulley wheel housing 52 which may be of aluminum or other metal in the form of a rectangular block. Housing 52 has a hollow portion 54 with an open top at its upper end to receive three pulley wheels 56*a*, 56*b* and 56*c* (FIG. 6). Pulley wheels 56*a*, 56*b* and 56*c* are of equal diameter and have a common axis. A shaft which may be either a solid rod or preferably a metal tube 58 forms an axis around which pulley wheels 56*a*, 56*b* and 56*c* can rotate. Tube 58 is capable of receiving a bolt or pin. At the top of each side of housing 52 are two upstanding off-set flanges 60 and 62. Flanges 60 and 62 extend the full length of each side of housing 52.

To close the open top of housing 52, a plastic cap 66 is snapped over flanges 60 and 62 with sufficient clearance to allow rotation of pulley wheels 56*a*, 56*b* and 56*c*. Plastic cap 66 which may be made of polypropylene or.other suitable solid plastic material has grooves in its lower surface corresponding to flanges 60 and 62 so that a tight fit can be had when plastic cap 66 is snapped in place. When plastic cap 66 is in place it also covers the otherwise open end of metal tube 44.

At the lower end of cylinder 45 is a second pulley assembly 50 similar in construction to pulley assembly 48. Pulley assembly 50 comprises a rectangular pulley wheel housing 68 which has a hollow portion 69 adopted to receive pulley wheels 70*a*, 70*b* and 70*c* (FIG. 7). Housing 68 which may be of aluminum or other metal has a central hole 72 to receive a shaft which may be either a solid rod or preferably a hollow tube 73 around which pulley wheels 70*a*, 70*b* and 70*c* rotate.

At the bottom of each side of housing 68 are two downwardly extending flanges 74 and 76 which extend the full length of each side of housing 68.

To close the open bottom of housing 68, a plastic cap 78 is snapped over flanges 74 and 76 with sufficient clearance to allow rotation of pulley wheels 70*a*, 70*b* and 70*c*. Plastic cap 78 is similar to plastic cap 66 previously described with reference to the pulley housing 48 at the top of tube 44. Plastic cap 78 has a slot 79 through which sash cord 90 leaves the balance assembly. Slot 79 is in registration with the groove in pulley wheel 70*b*.

A threaded bolt 80 is pushed through the opening in hollow tube 74 and through the opposite sides of tube 44 to secure the housing 68 within and to channel-shaped tube 44. A nut 82 is threaded onto bolt 80 to prevent disengagement thereof. Bolt 80 and nut 82 may be replaced by a fixed rivet or other rod-like element.

In this version of the balance assembly, the lower pulley assembly 50 is fixed and upper pulley assembly is free to move up and down in tube 44. As an alternative, the purpose of which will be explained hereinafter, bolt 80' may be inserted through a hole 84 (shown in the upper portion of FIG. 5) and through the hollow tubular axis 58 of pulley assembly 48 to secure upper pulley assembly 48 against movement. In this latter version, lower pulley assembly 50 is not secured by a bolt and lower pulley assembly would be free to reciprocate longitudinally in tube 44.

The axis of pulley assembly 48 formed by tube 58 is at right angles to the axis of pulley assembly 68 formed by tube 73. Pulley wheels 50*a*, 50*b* and 50*c* of pulley assembly 48 rotate in a vertical plane which is at right angles with respect to the vertical plane in which pulley wheels 70*a*, 70*b* and 70*c* of pulley assembly 68 rotate. This arrangement enables the sash cord 90 to move over the pulley wheels so that its various sections between the pulleys are able to lengthen and shorten without interference or undue rubbing against each other. Thus the useful life of sash cord 90 is lengthened.

A sash cord 90 is wound around pulley wheels 56*a*, 56*b*, 56*c*, 70*a* and 70*c*. Sash cord 90 may be a wire control cable, such as those used in aircraft. One end of sash cord 90 is connected to housing 68. Sash cord 90 is then wound around pulley wheels 56*c*, 70*c*, 56*a*, 70*a* and 56*b* in that order. For ease of lacing sash cord 90 around the pulley, end caps 66 and 78 are removed; thus exposing pulley wheels 56*a*, 56*b* and 56*c* of upper pulley housing 48 and pulley wheels 70*a*, 70*b* and 70*c* of lower pulley housing 68. Thus the sash cord 90 can be easily laced over the exposed pulley wheels. After lacing, the end caps 66 and 78 are snapped in place to prevent sash cord 90 from disengagement with the pulley wheels.

The free extremity 92 of sash cord 90 rides in the groove of pulley wheel 70*b* but is not wound around the pulley wheel. Pulley wheel 70*b* rotates when sash cord 90 moves in or out of the balance assembly and so sash cord 90 is not subject to excessive wear by rubbing against a fixed surface. The groove in pulley wheel **70*b* acts as a guide for sash cord 90 rather than a bearing surface, thus reducing the strain and wear on sash cord 90 where it exits from the balance assembly. The end 92 of sash cord 90 carries a hook member 96 which has a generally V or triangular shaped notch therein and a transversely extending flange 100 formed integral therewith with an aperture therein to which the end of the sash cord is knotted. The opposite end of the hook member has a toothed portion 102**, for the purpose of which will be later noted. As will be hereinafter identified, the hook members are adapted to ride below a lower guide on the sash to apply a spring bias to the same in a conventional manner.

The individual sash are also preferably of a metallic construction being made of extruded parts and held together in assembled relationship to form the four sides or sides, top and bottom of the individual sash. The particular details of this construction form no part of the present invention except to include provisions for forming of weather-stripping and guides as will be hereinafter noted. Thus, as will be seen in FIG. 1, the upper and outer sash 110 which is smaller in width dimensions than the lower and inner sash 116 is formed basically of side parts 120 with top and bottom frame parts 122, 124 respectively which are held together through any suitable means such as screws. The side parts 120 are generally channel shaped on their outer edges as will be seen in FIG. 3. Each of the sash are generally of the same construction. On the inner facing surface of the channeled edges is a weather-stripping flange portion 128 which projects translationally from the channel edges and mounts the weather-stripping material. The latter bears against the transversely extending flange portions 31 of the jamb channel to seal the window at this surface. Positioned in the channel shaped edges of each of the sash are upper and lower guide members identified at 130 and 132, respectively. The upper guide member 130 is made of a plastic material and is bendable or deflectable to permit the window to be rotated away from or over the projecting surface of the balance assembly upon removal. The lower guide member 132 is also a plastic part which is secured to the sash. Lower guide member 132 has a triangular shaped finger 136 projecting a short distance out from the main body portion of the guide to provide a pivot means around which the sash can be rotated for opening as illustrated in FIG. 2.

The frame parts when assembled include the suitable recessed surface 140 into which the glass pane 142 is positioned to be held therein through suitable rubber or vinyl mounting or glazing 144 or equivalent structure. These upper and lower guide parts are made to be plastic material, such a teflon, to provide a lubricated surface for ease in movement over the metal surface of the jamb channel and balance assembly. When installed the lower guide will project into the recesses 24, 25 or the jamb channels to ride there. The triangular projection 136 of each guide 132 projects into the recess and below the hook member 96 of the respective sash cord such that the generally triangular portion of the hook conforms to the shape of the projection 136. In this position the flange portion 100 is level and the tooth projecting portion 102 is directed away from the sides of the recess and geneally parallel thereto to permit the hooks to slide in the recess. A spring bias is thus supplied to the lower portion of the sash from the balance assembly in a conventional manner with the hook member sliding in the channel with window movement. The upper guides 130 ride on the projecting surfaces 40 of the balance assemblies 35 which are rigidly positioned in the extruded jamb channels so that no translational movement occurs therebetween. The flange portions 128 on each sash carry weather-stripping material to seal the surface of the sash in the jamb channel or window casing at the inner sides of the same with the weather-stripping flanges 32 and 38 in the jamb channel bearing against the outer surfaces of the respective sashes. Thus, the sash dimensions are such as to be slightly less than the distance between the exposed surfaces of the balance assembly so that the window may be readily removed. All draft or air movement will be sealed by virtue of the weather-stripping bearing against the sides of the sash and the sides of the jamb channel on the opposite surfaces thereof as will be best seen in FIG. 3.

In the well-known manner suitable weather-stripping material is placed in conventional weather-stripping flanges to seal the sash against air infiltration.

The hook member 96 has a toothed surface 102 as will be best seen in FIG. 4 which, when the hook member is rotated with rotation of the sash, will bite into the metal surface of the jamb channel or the side surface thereof to maintain the sash cord and hook member in an extended position when a sash is removed. Thus, upon movement of the sash up and down, the sash cord with a hook extremity of the same will follow the sash due to its positioning under the lower guide members 132 to apply a conventional spring bias to the sash to balance the same in this movement. Whenever the sash is to be removed from the casing, the upper edge of the same is gripped and the sash is rotated outwardly about an axis defined by the lower guide members 132. This rotation will cause the hook members to rotate in the jamb channel since they ride against the triangular surface 136. With rotation of the sash the hook members move to a position wherein the toothed surface will bite into the jamb channel and hold the hook 96 in position. The window is then removed by tilting the sash on one of its guide members to clear the other lower guide member 132 from the recess or jamb channel permitting the sash to be lifted out of the window casing. Both balance assemblies on either side of the jamb channel will have the respective hook members maintained in the position of sash removal so that the sash can be reinserted and installed in the window casing by reversing the procedure. The compressible or flexible upper guide member 130 insures that the upper end of the sash will be guided on the exposed surface of the balance assemblies. The weather-stripping surrounding the sash and carried by the sash and jamb assemblies, respectively, seal the sash on the sides thereof. The weather-stripping at the head frame part and on the sill frame part of the window casing similarly seal the upper and lower edges of the respective sashes in the closed position of the window.

The improved window assembly provides a simplified structure particularly adapted for metal window construction by means of which the sash may be mounted and positively guided in a window casing or in the jamb channels and yet may be readily removed therefrom for cleaning and maintenance purposes. The sash cords of the balance assemblies will be retained in a position where the sash may be reinserted so that the hooks will be underneath the lower guides on the sash to apply a spring bias to the same. The improved window construction provides a sealed unit in which the sash will be smoothly and firmly guided within the jamb channels or window casing preventing leakage around the same. The improved structure is particularly adapted for metal windows with extruded parts for low cost construction.

While the invention has been described in the environment of a removable window, the same construction can be used with non-removable windows also. If desired the pivotable arrangement of hook member 96 and triangular surface 136 may be replaced by a simple direct connection between the end of sash cords 90 and the sashes themselves. A simple bracket can be secured to the lower edges of each sash and sash cords 90 can be attached individually to each sash.

The novel balance assembly of the invention permits easy and reliable balancing of windows. Each window sash has a balance assembly connected to each of its sides by means of sash cord 90. Sash cord 90 is connected over the pulley wheels of pulley assemblies 48 and 50 to a fixed connection on pulley housing 68. As the window sash is lowered, sash cord 90 moves out of the balance assembly 44. As the sash cord emerges from the balance assembly the tension caused by the downward movement of the sash causes the pulley assemblies 48 and 50 to approach one another. Since pulley assembly 48 is fixed to the upper end of piston 46 and pulley assembly 50 is fixed to the lower end of cylinder 45, the compressing force caused by the tension on the sash cord 90 forces piston 46 to move further into cylinder 45 against the gas pressure in the cylinder. Thus, the window is balanced to remain in a desired position as the tension provided by the piston and cylinder assembly will hold it in place.

If the window 116 is moved upwardly, sash cord 90 moves into balance assembly 44 and the tension on the piston and cylinder assembly is relieved. Piston 46 tends to move outwardly from cylinder 45 and the pulley wheel assemblies 48 and 50 will move apart to keep tension on sash cord 90.

It will be remembered that bolt and nut assembly 80 and 82 can be inserted into hollow tube 74 to hold the pulley wheel housing 69 in fixed position relative to balance assembly receiving tube 44 or bolt and nut assembly 80' and 82' can be inserted into hollow tube 58 of pulley wheel assembly 48 to fix the upper pulley wheel assembly 48 with respect to balance assembly receiving tube 44. Only one pulley wheel assembly should be fixed in position at a given time leaving the other pulley wheel assembly free to reciprocate in balance assembly receiving tube 44.

If the bolt assembly fixes lower pulley assembly 50 in place, leaving the upper pulley assembly 48 to move, the pulley ratio will be 4 to 1 and a window of a given weight can be balanced. On the other hand, if the bolt 80' is inserted into hollow shaft 58 to fix the upper pulley assembly 48 into place, the pulley ratio will be 5 to 1 and a heavier window can be accommodated. The reason for this unexpected result is that sash cord 90 is wound around the three pulleys 56*a*, 56*b* and 56*c* of upper pulley assembly 48 and only around two pulleys 70*a* and 70*c* of the lower pulley assembly 50. Thus the number of pulley wheels which will be effective will vary from 3 to 2 depending upon which pulley wheel assembly travels.

With the pair of conventional spring balances, it used to take 30 to 40 pounds of effort to move a 140 to 180 pound window. With the novel piston and cylinder arrangement of the present invention, it takes only 10 to 15 pounds of effort to move the same window.

While what has been described is a novel balance assembly, it should be understood that the invention is not to be limited to the specific embodiment described, as many variations may be made. It is, therefore, contemplated that any and all such modifications be covered by the appended claims.

I claim:

1. A balance assembly adapted to be positioned in a side jamb of a window frame comprising:

an elongated housing having enclosing sidewalls and a back wall, a gas pressurized cylinder and piston assembly wherein said piston has one end partially enclosed within said cylinder and in which said piston is reciprocally movable within said enclosing sidewalls of said elongated housing, said cylinder and piston assembly being adapted to oppose said reciprocal movement, a first pulley assembly fixed to the end of said piston opposite said enclosed end, said first pulley assembly having a plurality of grooved pulley wheels and having a shaft forming the axis of rotation of said pulley wheels a second pulley assembly fixed to the end of said cylinder opposite said enclosed end of said piston, said second pulley assembly having a plurality of grooved pulley wheels and having a shaft forming the axis of rotation of said pulley wheels, means for locking one of said pulley assemblies against movement within said elongated housing assembly, a sash cord connected at one end to one of said pulley assemblies and wound alternately around pulleys of said first and second pulley assemblies with a free end of said sash cord extending through the lower end of said elongated housing, and a connector member secured to said free end of said sash cord, said connector being adapted to be connected to a window sash.

2. The balance assembly of claim 1 wherein said cylinder is adapted to be pressurized with a gas at a pressure sufficient to balance one-half the weight of one window.

3. The balance assembly of claim 1 wherein said cord is wound around all but one of the pulley wheels of said first and second pulley wheel assemblies and in which said sash cord is guided by a portion of the groove of said one pulley wheel.

4. The balance assembly of claim 1 wherein said axis of rotation of said first pulley wheel assembly is at right angles to the axis of rotation of said second pulley wheel assembly.

5. The balance assembly of claim 1 wherein at least one of said pulley assemblies has a pulley wheel housing, said housing having a pair of flanges extending outwardly beyond said pulley wheel assembly and a cover member having grooves on one side adapted to receive said flanges, whereby said pulley housing is closed by application of said cover member to prevent said sash cord from becoming disengaged from said grooves in said pulley wheels.

6. The balance assembly of claim 5 wherein said cover member has an area equal to the area between said sidewalls and said backwall of said elongated housing so as to form a dust shield for said elongated housing.

7. The balance assembly of claim 5 wherein one of said cover members has a slot centrally located in one side thereof, said slot being adapted to guide said sash cord into and out of said balance assembly.

8. The balance assembly of claim 1 wherein said shaft of at least one of said pulley assemblies is hollow.

9. The balance assembly of claim 8 wherein said means for locking said one of said pulley assemblies against movement within said elongated housing comprises a threaded bolt inserted through said hollow shaft and a nut assembled with said threaded bolt.

10. The balance assembly of claim 9 wherein said threaded bolt is inserted through said hollow shaft of said first pulley assembly.

11. The balance assembly of claim 9 wherein said threaded bolt is inserted through said hollow shaft of said second pulley assembly.

12. The balance assembly of claim 1 wherein said means for locking said one of said pulley assemblies is a rivet.

* * * * *